US011300333B2

(12) United States Patent
Jung et al.

(10) Patent No.: US 11,300,333 B2
(45) Date of Patent: Apr. 12, 2022

(54) COLD WATER GENERATION MODULE FOR WATER TREATMENT APPARATUS

(71) Applicant: LG ELECTRONICS INC., Seoul (KR)

(72) Inventors: Jisun Jung, Seoul (KR); Jintae Kim, Seoul (KR); Jaegeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 267 days.

(21) Appl. No.: 16/607,603

(22) PCT Filed: Apr. 10, 2018

(86) PCT No.: PCT/KR2018/004214
§ 371 (c)(1),
(2) Date: Oct. 23, 2019

(87) PCT Pub. No.: WO2018/199513
PCT Pub. Date: Nov. 1, 2018

(65) Prior Publication Data

US 2020/0080755 A1 Mar. 12, 2020

(30) Foreign Application Priority Data

Apr. 25, 2017 (KR) ..... 10-2017-0052733

(51) Int. Cl.
*F25B 21/02* (2006.01)
*F25D 31/00* (2006.01)
(Continued)

(52) U.S. Cl.
CPC ..... *F25B 21/02* (2013.01); *F25D 31/002* (2013.01); *F24F 5/0042* (2013.01);
(Continued)

(58) Field of Classification Search
CPC ..... F25B 21/02; F25B 2321/0212; F25B 2321/023; F25B 2321/0252; F25D 2700/00; F25D 29/005; F25D 31/002
See application file for complete search history.

(56) References Cited

U.S. PATENT DOCUMENTS 4,593,529 A * 6/1986 Birochik ..... F17C 13/02 62/3.3
5,737,923 A * 4/1998 Gilley ..... F28F 13/187 62/3.7
(Continued)

FOREIGN PATENT DOCUMENTS

KR 20-2010-0005329 5/2010
KR 10-2010-0131125 12/2010
(Continued)

OTHER PUBLICATIONS

Korean Office Action dated Jun. 1, 2021.
(Continued)

*Primary Examiner* — Filip Zec
(74) *Attorney, Agent, or Firm* — Ked & Associates LLP

(57) ABSTRACT

A thermoelectric cooling device includes a tank including an inlet hole and an outlet hole, a thermoelectric pad that faces an outer surface of the tank to cool liquid received in the tank, a heat dissipation unit including a heat transfer block coming into contact with the thermoelectric pad, a heat pipe that passes through the heat transfer block, a heat sink connected to the heat pipe, and a fan that blows air to the heat sink, and a controller that controls an output of the thermoelectric pad.

15 Claims, 9 Drawing Sheets

(51) Int. Cl.
*F24F 5/00* (2006.01)
*F25D 29/00* (2006.01)

(52) U.S. Cl.
CPC ..... *F25B 2321/023* (2013.01); *F25B 2321/0212* (2013.01); *F25B 2321/0252* (2013.01); *F25D 29/005* (2013.01)

(56) References Cited

U.S. PATENT DOCUMENTS 6,705,089 B2 * 3/2004 Chu ..... F25B 21/02 136/204
7,852,630 B2 * 12/2010 Cheng ..... H01L 23/467 361/700
8,605,226 B2 12/2013 Cho
9,504,189 B1 * 11/2016 Campbell ..... F25B 21/02
2006/0150637 A1 * 7/2006 Wauters ..... B67D 1/0869 62/3.64
2009/0279251 A1 * 11/2009 Liu ..... H05K 7/20336 361/690

FOREIGN PATENT DOCUMENTS

KR 10-2012-0076416 7/2012
KR 10-2014-0052462 5/2014
KR 10-2014-0098017 8/2014
KR 10-2015-0101662 9/2015
WO WO2012091499 * 7/2012 ..... F25D 11/00

OTHER PUBLICATIONS

International Search Report (English Translation) dated Aug. 6, 2018 issued in Application No. PCT/KR2018/004214.
Written Opinion (English Translation) dated Aug. 6, 2018 issued in Application No. PCT/KR2018/004214.

* cited by examiner

COLD WATER GENERATION MODULE FOR WATER TREATMENT APPARATUS

CROSS-REFERENCE TO RELATED PATENT APPLICATIONS

This application is a U.S. National Stage Application under 35 U.S.C. 5371 of PCT Application No. PCT/KR2018/004214, filed Apr. 10, 2018, which claims priority to Korean Patent Application No. 10-2017-0052733, filed Apr. 25, 2017, whose entire disclosures are hereby incorporated by reference.

TECHNICAL FIELD

The present disclosure relates to a cold water generation module for a water treatment apparatus.

BACKGROUND

In general, widely used water purifiers have a fundamental function in which raw water such as tap water or ground water is filtered by using a plurality of filters to provide drinking water that can be immediately drunk or store purified drinking water in a storage tank, and then provide cold water or hot water by using a cooling device and a heating device. Such a water purifier includes a plurality of filters for removing components harmful to the human body in addition to floating materials in raw water, eliminating odors, and sterilizing bacteria causing water-borne diseases.

That is, a general water purifier may selectively include a sediment filter through which raw water sequentially passes to generate purified water, a free carbon filter performing filtration through adsorption due to micropores of carbon black, a UV hollow fiber membrane filter including a UV hollow fiber membrane filter material to remove contaminants through a plurality of micropores distributed in a surface of a membrane, a reverse osmosis membrane filter, a post carbon filter, an ultraviolet sterilization filter, and the like.

Water purifiers are generally classified into storage-type water purifiers having a water storage tank therein and direct-type water purifiers having no water storage tank. Also, water purifiers are classified into counter top-type water purifiers, desk top-type water purifiers, under sink-type water purifiers, and the like according to an installation manner.

Furthermore, various methods are being used for cooling devices employed in the water purifiers. In recent years, cooling devices using thermoelectric modules have been introduced in consideration of aspects of miniaturization of a volume, reduction of vibration and noise, and a design. Such a thermoelectric module has an advantage of solving the limitations of the existing compressor method by applying a principle in which one side is cooled and the other side is heated when power is supplied.

FIG. 1 is an exploded perspective view of a cold water generation module using a thermoelement according to the related art.

Referring to FIG. 1, a cold water generation module using a thermoelement according to the related art includes a bypassing passage block that cools a fluid introduced by the thermoelement, has passages continuously disposed in a zigzag shape in top and bottom surfaces thereof, and has one side in which an outlet hole is defined, a plurality of cooling passage blocks disposed on both sides of the bypassing passage block so as to be respectively coupled to the top and bottom surfaces of the bypassing passage block and having passages continuously disposed in a zigzag shape to correspond to the passages provided in the bypassing passage block, a connection tube connecting the plurality of cooling passage blocks to each other, and the thermoelement closely attached to each of the plurality of cooling passage blocks to allow a fluid to be heat-exchanged.

However, the cold water generation module using the thermoelement according to the related art has a limitation that the plurality of thermoelements always operate regardless of a temperature of cold water to increase power consumption.

Also, the cold water generation module using the thermoelements according to the related art uses a heat sink for dissipating heat of a heat release surface of the thermoelement. Thus, even if one of the thermoelements is turned off to reduce power consumption, the heat is not properly cut off to cause heat loss, and thus, the power consumption increases.

DISCLOSURE

Technical Problem

Embodiments provide a cold water generation module for a water treatment apparatus which is improved in heat dissipation performance to more quickly dissipate heat energy generated from a heat release surface of a thermoelement while cold water is generated by using a heat absorption surface of the thermoelement, or the generated cold water is maintained in temperature.

Embodiments also provide a cold water generation module for a water treatment apparatus in which a plurality of thermoelements are individually controllable to reduce power consumption in a situation in which generated cold water is maintained in temperature in contrast to a situation in which the cold water is generated while water decreases in temperature.

Embodiments also provide a cold water generation module for a water treatment apparatus which is capable of blocking a thermal effect between thermoelements so that heat of the thermoelements that are turned on does not influence on the thermoelements that are turned off in a state in which at least one thermoelement of the plurality of thermoelements is turned off.

Embodiments also provide a cold water generation module for a water treatment apparatus which is capable of improving heat dissipation performance by dissipating heat through a heat sink having a large size even when only a portion of the plurality of thermoelements operates.

Embodiments also provide a cold water generation module for a water treatment apparatus which is capable of improving heat dissipation performance and thermal efficiency to more easily generate cold water and maintain a temperature of the generated cold water.

Technical Solution

In one embodiment, a cold water generation module for a water treatment apparatus includes: a cooling tank provided with an inlet hole through which water is introduced from the outside, an outlet hole through which the internal water is discharged, and an inner space communicating with the inlet hole and the outlet hole; a thermoelectric unit of which a heat absorption surface disposed on one side thereof is disposed to face an outer surface of the cooling tank to cool the water received in the cooling tank; a heat dissipation unit including a heat transfer block coming into contact with a heat release surface disposed on the other side of the thermoelectric unit, a heat pipe of which one side passes through the heat transfer block, a heat sink though which the other side of the heat pipe passes, and a blowing fan blowing air to the heat sink; and a control unit controlling an output of the thermoelectric unit.

At least two thermoelectric units may be provided to be spaced apart form each other.

The heat pipe may be separately provided in each of the thermoelectric units.

At least a portion of the heat pipe may be provided as a grooved type pipe for blocking heat transfer from the heat sink to the heat transfer block.

At least a portion of the heat pipe may be provided as a sintered type pipe for transferring heat between the heat sink and the heat transfer block.

The cold water generation module may further include a temperature sensor detecting a temperature of the water received in the cooling tank to transmit the detected temperature information to the control unit.

The control unit may independently control the thermoelectric units.

The control unit may turn the at least two thermoelectric units on when the temperature of the water received in the cooling tank is higher than a preset target temperature.

The control unit may turn at least one thermoelectric unit off when the temperature of the water received in the cooling tank reaches the preset target temperature.

The control unit may always turn at least one thermoelectric unit on.

The heat sink may be disposed above the cooling tank, and the thermoelectric units may be vertically disposed.

The control unit may selectively turn the lower thermoelectric unit off.

A heat transfer plate may be disposed between the thermoelectric unit and the cooling tank.

The cold water generation module may further include: a case surrounding the outside of the cooling tank; and an insulation member filled between the cooling tank and the case.

The heat sink and the blowing fan may be disposed outside the case.

The details of one or more embodiments are set forth in the accompanying drawings and the description below. Other features will be apparent from the description and drawings, and from the claims.

Advantageous Effects

According to the embodiments the heat dissipation performance may be improved to more quickly dissipate the heat energy generated from the heat release surface of the thermoelement while the cold water is generated by using the heat absorption surface of the thermoelement, or the generated cold water is maintained in temperature.

Also, the plurality of thermoelements may be individually controllable to reduce the power consumption in the situation in which the generated cold water is maintained in temperature in contrast to the situation in which the cold water is generated while water decreases in temperature.

Also, the thermal effect between thermoelements may be blocked so that the heat of the thermoelements that are turned on does not influence on the thermoelements that are turned off in the state in which at least one thermoelement of the plurality of thermoelements is turned off.

Also, the heat dissipation performance may be improved by dissipating the heat through the heat sink having a large size even when only a portion of the plurality of thermoelements operates.

Also, the heat dissipation performance and the thermal efficiency may be improved to more easily generate the cold water and maintain a temperature of the generated cold water.

DETAILED DESCRIPTION

Hereinafter, exemplary embodiments will be described in detail with reference to the accompanying drawings. The invention may, however, be embodied in many different forms and should not be construed as being limited to the embodiments set forth herein, and a person of ordinary skill in the art, who understands the spirit of the present invention, may readily implement other embodiments included within the scope of the same concept by adding, changing, deleting, and adding components; rather, it will be understood that they are also included within the scope of the present invention.

The drawings attached to the following embodiments are embodiments of the scope of the invention, but to facilitate understanding within the scope of the present invention, in the description of the fine portions, the drawings may be expressed differently according to the drawings, and the specific portions may not be displayed according to the drawings, or may be exaggerated according to the drawings.

The present disclosure relates to a cold water generation module for a water treatment apparatus, which is capable of effectively dissipating heat generated from a heat release surface, individually controlling thermoelements according to a required load, and blocking a thermal effect between the thermoelements while cold water is generated by using heat absorption surfaces of the thermoelements.

Hereinafter, a configuration and an operation of a cold water generation module for a water treatment apparatus will be described in detail with reference to the accompanying drawings.

Figure 1:
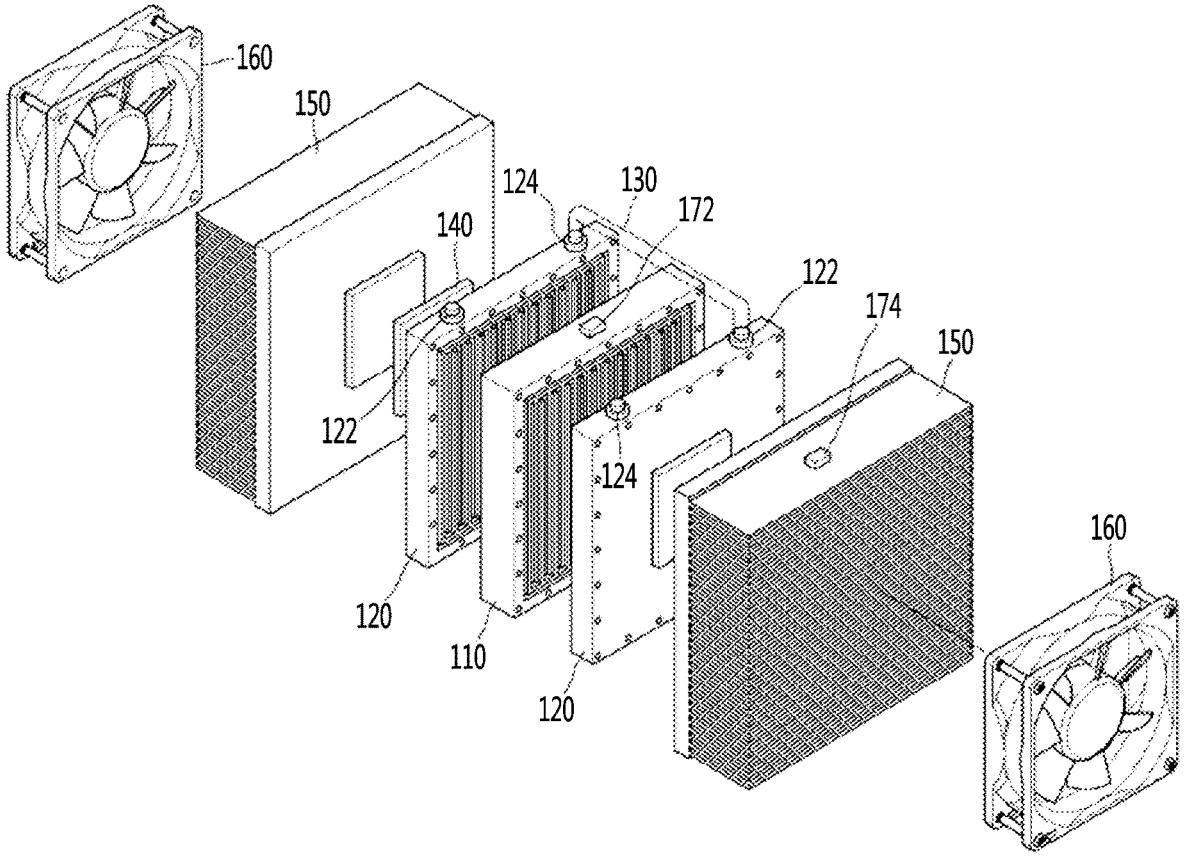
FIG. 1 is an exploded perspective view of a cold water generation module using a thermoelement according to the related art.
Figure 2:
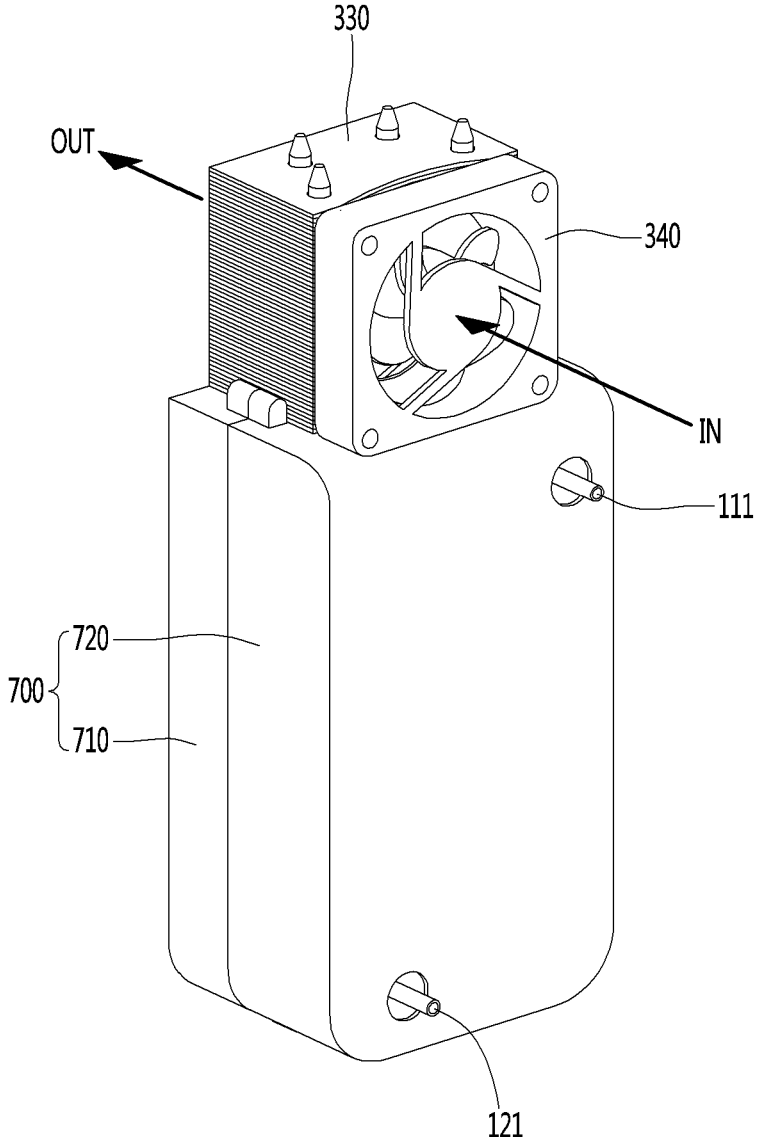
FIG. 2 is a perspective view of a cold water generation module for a water treatment apparatus according to an embodiment.
Figure 3:
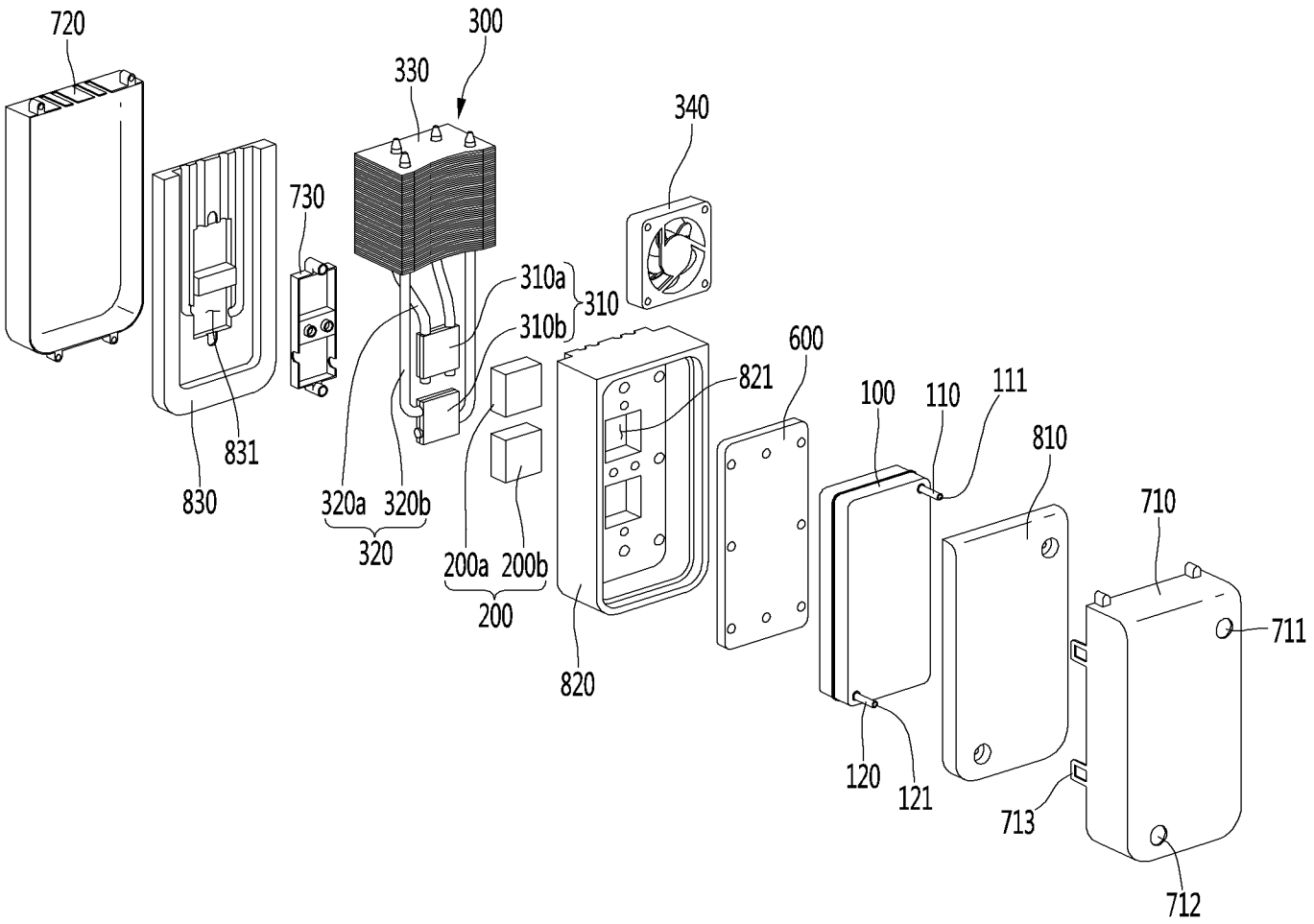
FIG. 3 is an exploded perspective view of the cold water generation module for the water treatment apparatus according to an embodiment.
Figure 4:
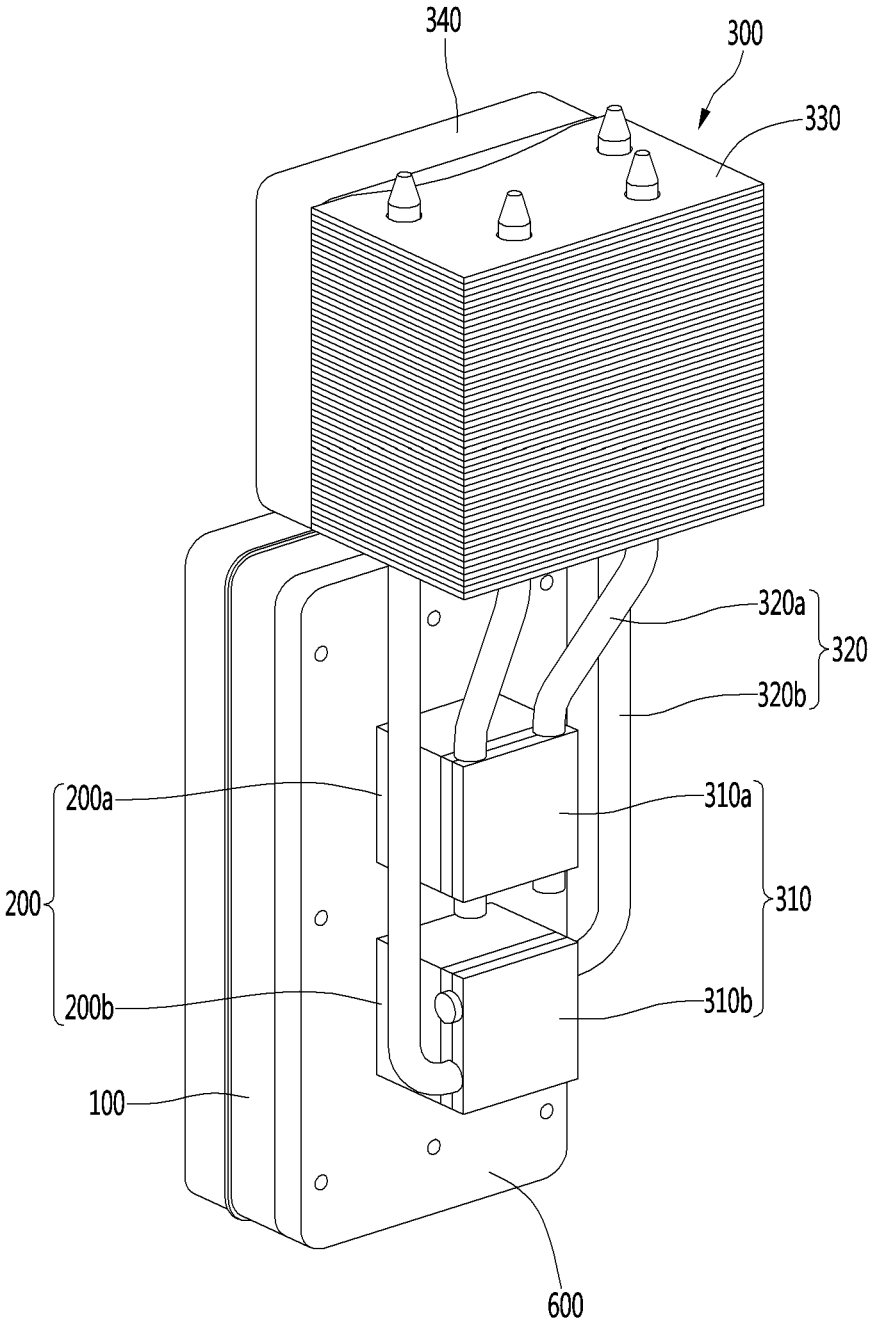
FIG. 4 is a block diagram illustrating a portion of the cold water generation module for the water treatment apparatus according to an embodiment.
Figure 5:
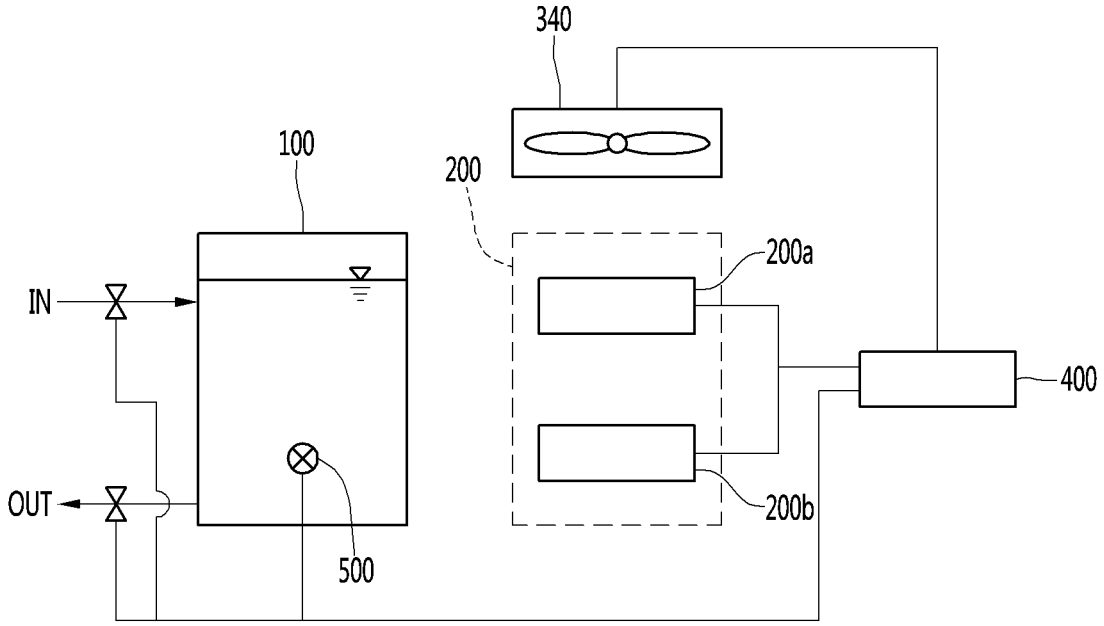
FIG. 5 is a perspective view of a cooling tank, a thermoelectric unit, and a heat dissipation unit that are portions of components according to an embodiment.

FIG. 2 is a perspective view of a cold water generation module for a water treatment apparatus according to an embodiment, FIG. 3 is an exploded perspective view of the cold water generation module for the water treatment apparatus according to an embodiment, FIG. 4 is a block diagram illustrating a portion of the cold water generation module for the water treatment apparatus according to an embodiment, and FIG. 5 is a perspective view of a cooling tank, a thermoelectric unit, and a heat dissipation unit that are portions of components according to an embodiment.

Referring to FIGS. 2 and 5, a cold water generation module for a water treatment apparatus includes a cooling tank 100, a thermoelectric unit 200, a heat dissipation unit 300, a control unit (or controller) 400, a heat transfer plate 600, a case 700, and an insulation member 800.

In detail, the cooling tank 100 is provided with an inlet hole 111 through which water is introduced from the outside, an outlet hole 121 through which the water is discharged, and an inner space communicating with the inlet hole 111 and the outlet hole 121.

Here, the inlet hole 111 may be defined in a water inlet tube 110 extending to the outside of the cooling tank 100, and also, the outlet hole 121 may be defined in a water outlet tube 120 extending to the outside of the cooling tank 100.

The water introduced into the cooling tank 100 through the inlet hole 111 may be cooled while staying in the cooling tank 100 to generate cold water and then be discharged out of the cooling tank 100 through the outlet hole 121.

In this embodiment, the cooling tank 100 may be made of a material having high thermal conductivity such as aluminum (Al).

Also, the inlet hole 111 may be defined in an upper portion of the cooling tank 100, and the outlet hole 121 may be defined in a lower portion of the cooling tank 100.

Also, the inlet hole 111 and the outlet hole 121 may be disposed in a diagonal direction.

That is, the inlet hole 111 may be defined in an upper end of one side of the cooling tank 100, and the outlet hole 121 may be defined in a lower end of the other side of the cooling tank 100.

When the inlet hole 111 and the outlet hole 121 are provided as described above, only the coldly cooled cold water may be discharged to the outside through the outlet hole 121.

Also, since the inlet hole 111 and the outlet hole 121 are disposed to be spaced apart from each other, the water introduced through the inlet hole 111 may be prevented from being discharged through the outlet hole 121 before being cooled.

It is necessary to provide a heat absorption unit so as to cool the water received in the cooling tank 100 as described above. According to an embodiment, the thermoelectric unit 200 is provided as an example of the heat absorption unit.

The thermoelectric unit 200 has one side serving as a heat absorption surface 201 and the other side serving as a heat release surface 202 when power is supplied from the outside.

Thus, the heat absorption surface 201 disposed on the one side of the thermoelectric unit 200 may be disposed to face an outer surface of the cooling tank 100 to cool the water received in the cooling tank 100.

Here, the thermoelectric unit 200 may be directly connected while the heat absorption surface 201 comes into contact with the outer surface of the cooling tank 100 or indirectly connected with a separate medium therebetween.

The thermoelectric unit 200 may include a thermoelement. For reference, the thermoelement may be a metal element constituted by a p-type semiconductor and an n-type semiconductor and cause Peltier heat absorption and release when direct current flows.

Also, the thermoelectric unit 200 may be constituted by combining a plurality of thermoelements to improve a cooling effect.

Since the thermoelectric unit 200 is provided as described above, heat energy of the cooling tank 100 directly or indirectly connected to the heat absorption surface 201 of the thermoelectric unit 200 is taken by the heat absorption surface 201, and thus, the cooling tank 100 may be cooled to decrease in temperature while cooling the water received therein and thereby to generate cold water.

In the above-described process, since heat is generated from the heat release surface 202 of the thermoelectric unit 200, it is necessary to provide a heat dissipation unit for dissipating the generated heat. According to an embodiment, the heat dissipation unit 300 is provided as an example of the above-described heat dissipation unit.

The heat dissipation unit 300 may be implemented in various manners according to various embodiments as long as heat generated from the heat release surface 202 of the thermoelectric unit 200 is dissipated.

In detail, the heat dissipation unit 300 may include a heat transfer block 310 coming into contact with the heat release surface 202 disposed on the other side of the thermoelectric unit 200, a heat pipe 320 of which one side passes through the heat transfer block 310, a heat sink 330 though which the other side of the heat pipe 320 passes, and a blowing fan 340 blowing air to the heat sink 330.

The heat transfer block 310 comes into surface contact with the heat release surface 202 of the thermoelectric unit 200 to transfer heat energy generated from the heat release surface 202 to the heat pipe 320. Here, the heat transfer block 310 may be connected to the heat release surface 202 of the thermoelectric unit 200 in an adhesion manner.

As described above, the heat energy transferred to the heat pipe 320 through the heat transfer block 310 is transferred to the heat sink 330 along the heat pipe 320 and then released to the outside through the heat sink 330 having a large surface area. That is, air cooling is performed.

For example, the heat pipe 320 may have a hollow, and a heat transfer oil may be filled into the hollow of the heat pipe 320.

For another example, the heat pipe 320 may not have the hollow.

Also, the heat pipe 320 may be provided in plurality to more quickly transfer the heat energy of the heat transfer block 310 to the heat sink 330. For example, the heat pipe 320 may be disposed on both sides of the heat transfer block 310.

Also, the blowing fan 340 supplies air for cooling to the heat sink 330. Thus, heat may be more effectively released from the heat sink 330. That is, the air cooling of the heat sink 330 may be more quickly performed.

The control unit 400 may control an output of the thermoelectric unit 200 and an output of the blowing fan 340.

For example, when an amount of water received in the cooling tank 100 is large, or a temperature of water received in the cooling tank 100 is high, the control unit 400 may increase the output of the thermoelectric unit 200 and accordingly increase the output of the blowing fan 340.

For example, when an amount of water received in the cooling tank 100 is small, or a temperature of water received in the cooling tank 100 is low, the control unit 400 may decrease the output of the thermoelectric unit 200 and accordingly decrease the output of the blowing fan 340.

A water level measurement sensor measuring a level of water received in the cooling tank 100 to transmit the measured value to the control unit 400 or a flow rate detection sensor detecting a flow rate of water introduced into the cooling tank 100 or discharged from the cooling tank 100 to transmit the detected value to the control unit 400 may be additionally provided to perform the active control of the control unit 400 as described above.

Also, a temperature senor detecting a temperature of water received in the cooling tank 100 or a temperature of water introduced into the cooling tank 100 or discharged from the cooling tank 100 to transmit the detected temperature value to the control unit 400 may be additionally provided.

Referring again to FIGS. 3 and 5, the heat transfer plate 600 may be disposed between the thermoelectric unit 200 and the cooling tank 100.

The heat transfer plate 600 may be made of a material having high thermal conductivity such as aluminum. The heat transfer plate 600 may have the same area as the cooling tank 100.

In general, since the thermoelectric unit 200 has a size less than that of the cooling tank 100, when the thermoelectric unit 200 is attached to the cooling tank 100, excessive cooling may occur at only a portion of an area of the cooling tank 100, and cooling may not be properly performed at the remaining area to deteriorate cold water generation efficiency.

However, when the heat transfer plate 600 is provided, the cooling may be uniformly performed on the entire area of the cooling tank 100, and thus, the cold water generation may uniformly occur on the entire area of the cooling tank 100.

The cooling tank 100, the thermoelectric unit 200, and the heat transfer plate 600, which are constituted as described above are accommodated in the case 700.

Here, the case 700 may be provided as a single body or a separably coupled assembly.

In the latter case, the case 700 may include a first case 710 disposed on one side of the cooling tank 100 and a second case 720 disposed on the other side of the cooling tank 100. Also, through-holes 711 and 712 through which the water inlet tube 110 and the water outlet tube 120 of the cooling tank 100, which are described above, pass may defined in one of the cases 710 and 720. Thus, the water inlet tube 110 and the water outlet tube 120 may be exposed to the outside.

Also, coupling units 713 coupled to each other may be disposed at positions corresponding to the cases 710 and 720. Thus, the case 700 may be separated from each other or coupled again to each other by the user as necessary.

Also, the insulation member for thermally insulating the cooling tank 100 may be filled into the case 700.

For example, the insulation member 800 may be made of a polyurethane (PU) material. Here, the insulation member 800 may be formed by foaming and filling polyurethane in a state in which the cooling tank 100 is accommodated in the case 700.

In this embodiment, the insulation member may include a first insulation member 810 disposed between one side of the cooling tank 100 and the case 710, a second insulation member 820 disposed on the other side of the cooling tank 100 and having a mounting hole 821 in which the thermoelectric unit 200 is accommodated, and a third insulation member 830 having an accommodation groove 831 in which the heat transfer block 310 and the heat pipe 320 are accommodated and disposed between the case 720, the heat transfer block 310, and the heat pipe 320.

Also, an auxiliary case 730 accommodating at least a portion of the heat transfer block 310 or the heat pipe 320 may be additionally provided in the case 700.

In this embodiment, portions of the heat sink 330, the blowing fan 340, and the heat pipe 320 may be disposed outside the case 700 to secure heat dissipation properties.

The cold water generation module for the water treatment apparatus according to an embodiment may include the plurality of thermoelectric units 200, which are individually controllable.

Figure 6:
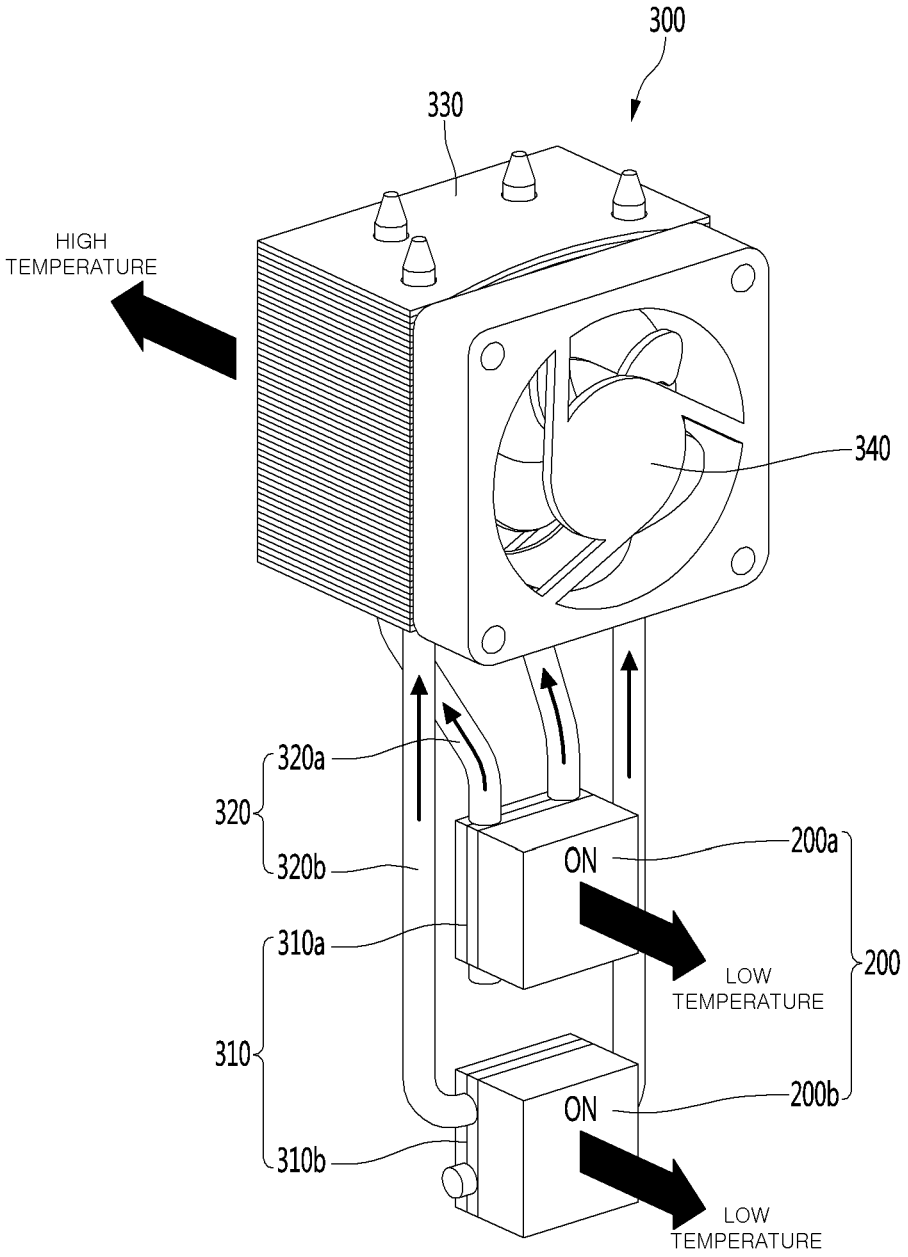
FIG. 6 is a perspective view illustrating a heat transfer state of the thermoelectric unit and the heat dissipation unit in a cold water generation mode.
Figure 7:
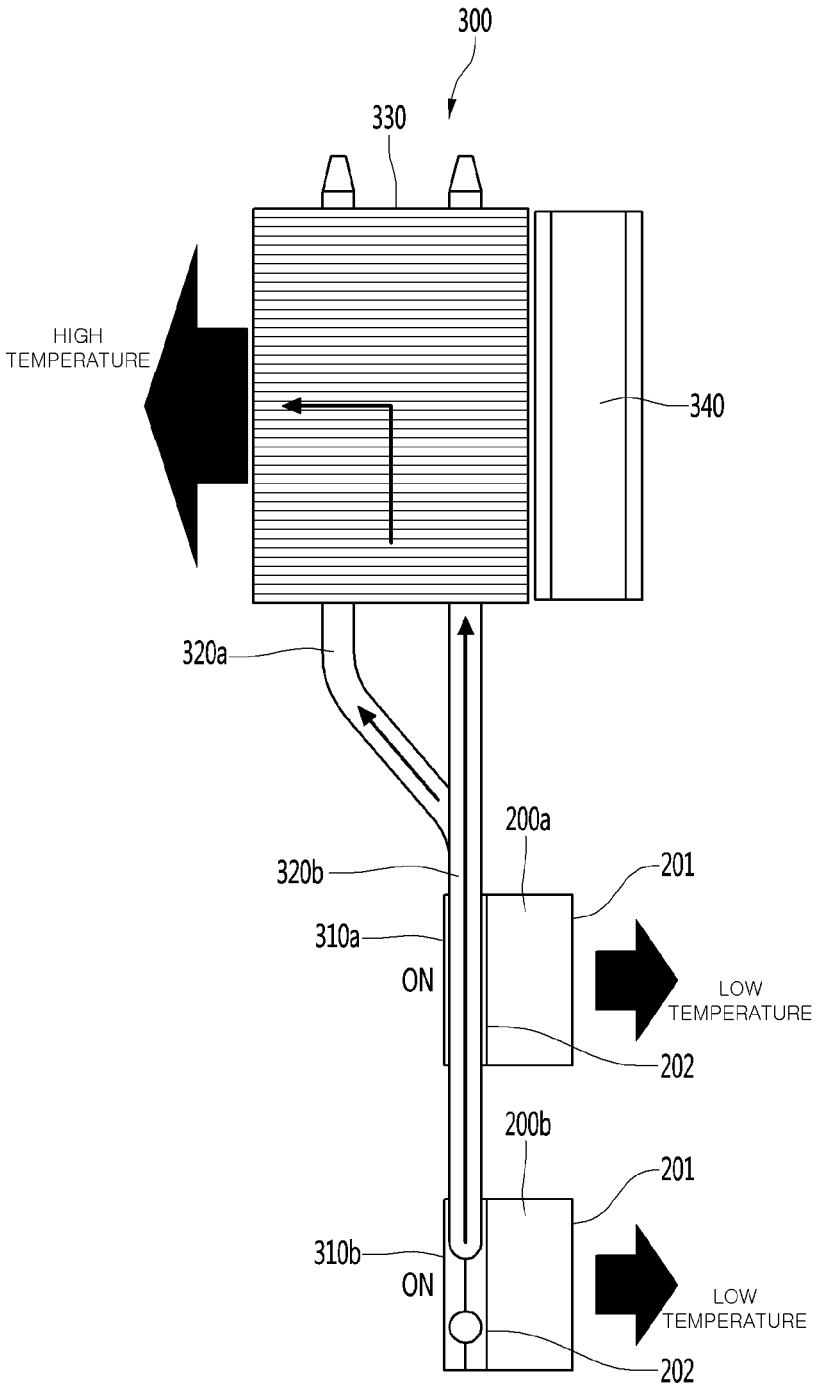
FIG. 7 is a side view illustrating the heat transfer state of the thermoelectric unit and the heat dissipation unit in a cold water generation mode.
Figure 8:
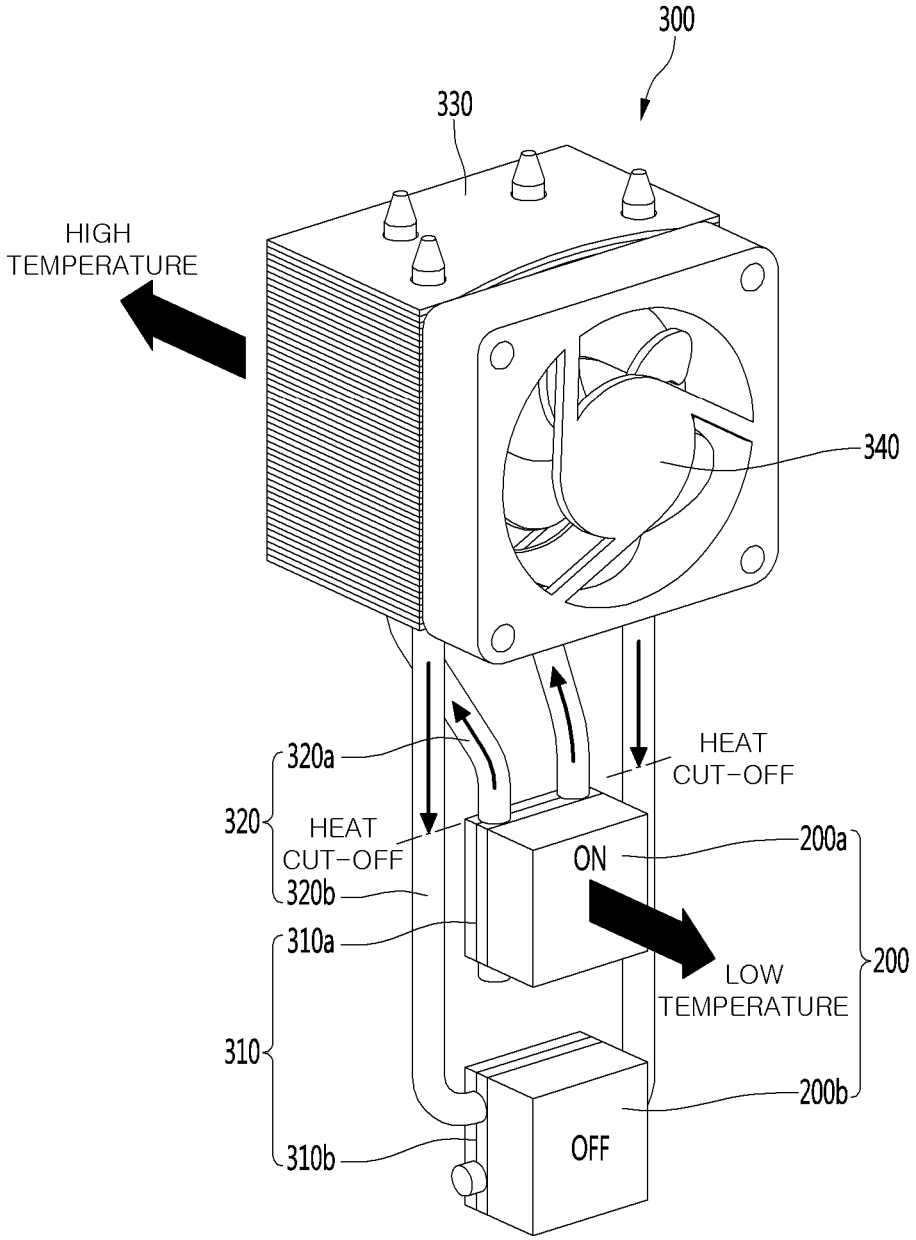
FIG. 8 is a perspective view illustrating a heat transfer state of the thermoelectric unit and the heat dissipation unit in a cold water maintenance mode.
Figure 9:
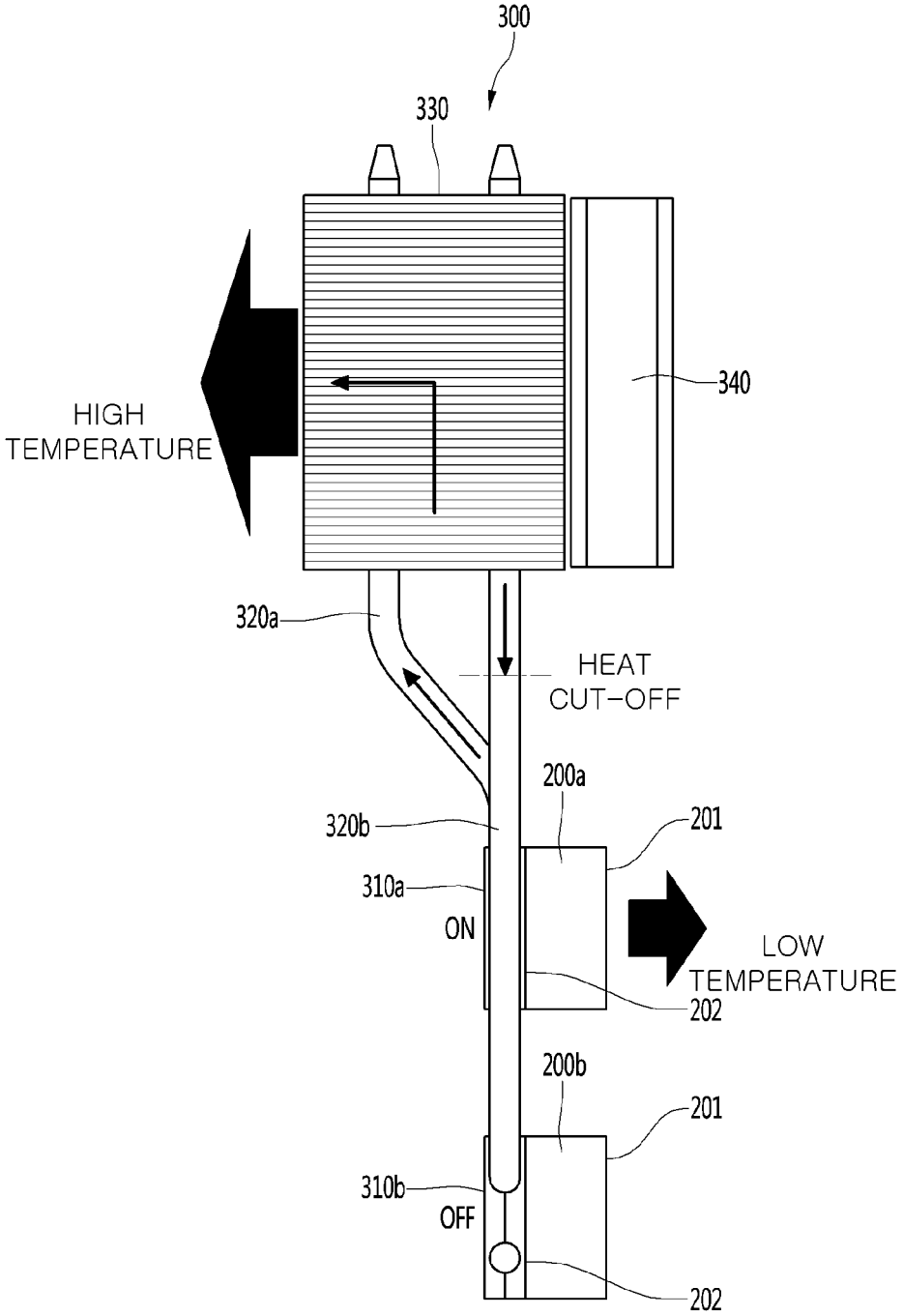
FIG. 9 is a side view illustrating the heat transfer state of the thermoelectric unit and the heat dissipation unit in a cold water maintenance mode.

FIG. 6 is a perspective view illustrating a heat transfer state of the thermoelectric unit and the heat dissipation unit in a cold water generation mode, FIG. 7 is a side view illustrating the heat transfer state of the thermoelectric unit and the heat dissipation unit in a cold water generation mode, FIG. 8 is a perspective view illustrating a heat transfer state of the thermoelectric unit and the heat dissipation unit in a cold water maintenance mode, and FIG. 9 is a side view illustrating the heat transfer state of the thermoelectric unit and the heat dissipation unit in a cold water maintenance mode.

Referring to FIGS. 6 to 9, at least two thermoelectric units 200 may be provided to be spaced apart from each other.

Here, the plurality of thermoelectric units 200 may be disposed in a horizontal or vertical direction.

For example, the thermoelectric unit 200 may include a first thermoelectric unit 200*a* disposed at an upper side and a second thermoelectric unit 200*b* disposed at a lower side.

The first and second thermoelectric units 200*a* and 200*b* may be attached to upper and lower portions of the heat transfer plate 600 or the cooling tank 100, respectively.

Also, a separate heat transfer block 310 may be attached to each of the first and second thermoelectric units 200*a* and 200*b*. That is, a first heat transfer block 310*a* may be attached to a heat release surface of the first thermoelectric unit 200*a*, and a second heat transfer block 310*b* may be attached to a heat release surface of the second thermoelectric unit 200*b*.

Also, the separate heat pipe 320 may be connected to each of the first and second heat transfer blocks 310*a* and 310*b*. That is, one side of a first heat pipe 320*a* may pass through the first heat transfer block 310*a*, and one side of a second heat pipe 320*b* may pass through the second heat transfer block 310*b*.

Here, the first and second heat pipes 320*a* and 320*b* may be respectively connected to the separate heat sinks 330 or may pass through the same heat sink 330 to be connected.

In the latter case, heat energy of the heat release surface of the first theremoelectric unit 200*a* may be released from the heat sink 330 via the first heat transfer block 310*a* and the first heat pipe 320*a*, and heat energy of the heat release surface of the second thermoelectric unit 200*b* may be released from the heat sink 330 via the second heat transfer block 310*b* and the second heat pipe 320*b*.

Thus, even when a situation in which only the first thermoelectric unit 200*a* operates, the heat may be dissipated through the heat sink 330 having a large size to improve heat dissipation performance.

Here, the first heat pipe 320*a* may be disposed on each of both sides of the first heat transfer block 310*a*, and the second heat pipe 320*b* may be disposed on each of both sides of the second heat transfer block 310*b*.

Also, the first heat pipe 320*a* may pass through a central portion of one side of the heat sink 330 and then be fixed, and the second heat pipe 320*b* may pass through a surrounding portion of the other side of the heat sink 330 and then be fixed.

In this case, since the first and second heat pipes 320*a* and 320*b* are maximally spaced apart from each other on the heat sink 330, a thermal effect therebetween may be reduced to improve the heat dissipation performance.

Referring again to FIG. 4, the control unit 400 may independently control the thermoelectric units 200*a* and 200*b*.

In detail, the control unit 400 may turn the first thermoelectric unit 200*a* on and turn the second thermoelectric unit 200*b* off.

On the other hand, the control unit 400 may turn the first thermoelectric unit 200*a* off and turn the second thermoelectric unit 200*b* on.

Also, the control unit 400 may turn both the first and second thermoelectric units 200*a* and 200*b* on or off.

Also, the control unit 400 may turn both the first and second thermoelectric units 200*a* and 200*b* on, but differently control the outputs of the first and second thermoelectric units 200*a* and 200*b*.

For example, the control unit 400 may turn at least two thermoelectric units 200*a* and 200*b* on in a 'cold water generation mode' in which a temperature of water received in the cooling tank 100 is higher than a preset target temperature.

Here, the target temperature may represent a required temperature of cold water to be dispensed.

In detail, when a temperature of water received in the cooling tank 100 is higher than the target temperature, since the temperature of the water has to be lowered to the target temperature, the control unit 400 may supply power to the at least two thermoelectric units 200*a* and 200*b* to more quickly cool the water received in the cooling tank 100.

For another example, the control unit 400 may turn at least one thermoelectric unit 200*b*, which is in a turn-on state, off in a 'temperature maintenance mode' in which the temperature of the water received in the cooling tank 100 is equal to or lower than the target temperature.

Here, the target temperature may represent a required temperature of cold water to be dispensed.

In detail, when the temperature of the water received in the cooling tank 100 is equal to or lower than the target temperature, it is unnecessary to decrease the temperature of the water, but a temperature of the cold water has to be maintained. As described above, it is necessary to supply power to the plurality of thermoelectric units 200*a* and 200*b* so as to maintain the temperature of the cold water. Thus, the control unit 400 may turn at least one of the thermoelectric unit 200*b*, which is turned on in the 'cold water generation mode', off.

Thus, power consumption in the 'temperature maintenance mode' may be reduced.

Also, as described above, the temperature sensor 500 detecting a temperature of water received in the cooling tank 100 to transmit the detected temperature value to the control unit 400 may be further provided for the operation of the control unit 400.

The temperature sensor 500 may be disposed inside the cooling tank 100 or disposed outside the cooling tank 100.

Also, the temperature sensor 500 may be disposed in the water outlet tube 120 through which the cold water discharged from the cooling tank 100 flows.

Thus, the control unit 400 may receive the temperature information of the cold water, which is detected by the temperature sensor 500 and compare the temperature of cold water to the target temperature in real-time to control the turn on/off of the thermoelectric units 200*a* and 200*b*.

The control unit 400 may always turn at least one thermoelectric unit 200 on. This is done for preventing the temperature of the cold water received in the cooling tank 100 from being higher than the target temperature.

When power is always applied to the thermoelectric unit 200*a* as described above, the user may take the cold water in real-time at a desired time.

When the thermoelectric unit 200*a* is always turned on as described above, the thermoelectric unit 200*a* may have a thermal influence on the thermoelectric unit 200*b* that is turned off.

Referring to FIGS. 8 and 9, heat energy released from the heat release surface of the first thermoelectric unit 200*a* that is turned on may be transferred to the second thermoelectric unit 200*b* through the heat sink 330, and thus be applied to the cooling tank 100 directly or indirectly connected to the second thermoelectric unit 200*b*.

In this case, the thermal efficiency may significantly decrease to increase the power consumption.

For solving this limitation, at least a portion of the second heat pipe 320*b* connected to the second thermoelectric unit 200*b* may be provided as a grooved type pipe for blocking heat transfer from the heat sink 330 to the second heat transfer block 310*b*.

Thus, when the second thermoelectric unit 200*b* is turned on, heat energy generated from the heat release surface of the second thermoelectric unit 200*b* may be transferred to the heat sink 330 through at least a portion of the second heat pipe 320*b*. Also, when the second thermoelectric unit 200*b* is turned off, heat energy of the heat sink 330 may be prevented from being transferred to the second heat transfer block 310*b* through the at least a portion of the second heat pipe 320*b*.

Thus, the thermal effect from the heat sink 330 to the second heat transfer block 310*b* may be blocked to improve the thermal efficiency and the energy efficiency in the 'temperature maintenance mode'.

In this embodiment, the grooved type pipe may represent various known heat pipes as long as the heat transfer efficiency from the heat sink 330 to the second heat transfer block 310*b* is less than that from the second heat transfer block 310*b* to the heat sink 330.

At least a portion of the first heat pipe 320*a* disposed at a side of the first thermoelectric unit 200*a* that is always turned on may be provided as a sintered type pipe for transferring heat between the heat sink 330 and the first heat transfer block 310*a*.

That is, the first thermoelectric unit 200*a* that is always turned on may always generate heat. Thus, the generated heat energy has to be always transferred to the heat sink 330 through the first heat transfer block 310*a*. Also, in case of the sintered type pipe, since the heat transfer efficiency is high, if the first heat pipe 320*a* is provided as the sintered type pipe, the heat transfer efficiency from the first heat transfer block 310 to the heat sink 330 may be improved to improve the heat dissipation performance.

In this embodiment, the sintered type pipe may represent various known heat pipes as long as the heat transfer efficiency from the first heat transfer block 310*a* to the heat sink 330 is high.

Also, the heat sink 330 may be disposed above the cooling tank 100, and the thermoelectric units 200*a* and 200*b* may be vertically disposed.

When the thermoelectric units 200*a* and 200*b* may be vertically disposed as described above, the temperature of the cold water received in the cooling tank 100 may be uniformly maintained.

In detail, the water received in the cooling tank 100 may be uniformly mixed while the coldly cooled cold water flows downward by the convention current phenomenon.

Also, the stepwise control according to the target temperature may be possible.

Also, the heat sink 330 may be disposed on a front or rear upper portion of the cooling tank 100. As a result, the thermal effect due to the heat energy released from the heat sink 330 is transferred to the cooling tank 100 may be prevented.

Also, the blowing fan 340 may be disposed vertically above the cooling tank 100. Also, the vertical upward direction has to match an air suction direction of the blowing fan 340. That is, it is necessary to dispose the cooling tank 100 so that the vertical upward direction of the cooling tank 100 does not match an air discharge direction of the blowing fan 340.

This is done because air blown from the blowing fan 340 is heated while passing through the heat sink 330, and the heated air has an influence on the cooling tank 100 to deteriorate the thermal efficiency of the cooling tank 100.

Thus, to improve the cooling performance of the cooling tank 100, the blowing fan 340 may be disposed vertically above the cooling tank 100 or disposed in the suction direction of the blowing fan 340.

Also, the control unit 400 may selectively turn the thermoelectric unit 200, which is disposed at the lower side, off.

In this embodiment, since the heat sink 330 is disposed above the thermoelectric unit 200*b*, and the upper thermoelectric unit 200*a*, which is disposed at the upper side, is closer to the heat sink 330, the heat dissipation performance of the thermoelectric unit 200 disposed at the relatively upper side may be high.

Therefore, the thermoelectric unit 200*a* that is closer to the heat sink 330 may be always turned on, and the thermoelectric unit 200*b* that is disposed at the relatively lower side may be selectively turned off.

Also, when the thermoelectric unit 200*a* disposed at the upper side is turned on, the upper portion of the cooling tank 100 may be cooled, and the cold water cooled at the upper portion may flow downward due to the convection current phenomenon, and thus, the water in the cooling tank 100 may be uniformly mixed. Therefore, the user may take the cold water having the uniform temperature.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A thermoelectric cooling device, comprising:

a tank that defines an inner space and includes an inlet hole through which liquid is introduced to the inner space and an outlet hole through which the liquid is discharged from the inner space;

a thermoelectric device having a first surface that faces an outer surface of the tank and configured to absorb heat from the liquid stored in the tank;

a heat dissipation unit comprising:

a heat transfer block attached to a second surface of the thermoelectric device, the second surface being opposite the first surface and configured to transfer the heat absorbed from the liquid;

a heat sink configured to dissipate the heat from the heat transfer block;

a heat pipe configured to connect the heat transfer block to the heat sink; and a fan configured to circulate air over the heat sink;

a controller configured to control an output of the thermoelectric device, and a temperature sensor configured to detect a temperature of the liquid stored in the tank and to transmit information of the detected temperature to the controller, and wherein the thermoelectric device comprises first and second thermoelectric devices spaced apart from each other, the first and second thermoelectric devices facing the outer surface of the tank and configured to absorb heat from the liquid stored in the tank, and wherein the heat pipe comprises a plurality of heat pipes, and each of the first and second thermoelectric devices is connected to a separate heat pipe among the plurality of heat pipes, and wherein the controller is configured to control each of the first and second thermoelectric devices independently from each other, and wherein the controller is configured to turn on the first and second thermoelectric devices when the temperature of the liquid stored in the tank is higher than a predetermined temperature, and wherein the controller is configured to turn off at least one of the first and second thermoelectric devices when the temperature of the liquid stored in the tank reaches the predetermined temperature.

2. The thermoelectric cooling device according to claim 1, wherein at least a portion of at least one of the plurality of heat pipes is a grooved type pipe configured to prevent heat transfer from the heat sink to the heat transfer block.

3. The thermoelectric cooling device according to claim 1, wherein at least a portion of at least one of the plurality of heat pipes is a sintered type pipe configured to transfer heat between the heat sink and the heat transfer block.

4. The thermoelectric cooling device according to claim 1, wherein the controller is configured to maintain at least one of the first and second thermoelectric devices in an always on state.

5. The thermoelectric cooling device according to claim 1, wherein the heat sink is provided above the tank, and the first and second thermoelectric devices are arranged vertically below the heat sink.

6. The thermoelectric cooling device according to claim 5, wherein the controller is configured to selectively turn the lower thermoelectric plate off.

7. The thermoelectric cooling device according to claim 1, wherein a heat transfer plate is arranged between the thermoelectric device and the tank.

8. The thermoelectric cooling device according to claim 1, further comprising:

a case that surrounds an outside of the tank; and an insulation member provided between the tank and the case.

9. The thermoelectric cooling device according to claim 8, wherein the heat sink and the fan are provided outside the case.

10. A thermoelectric cooling device, comprising:

a tank configured to store a liquid;

first and second thermoelectric devices configured to absorb heat from the liquid stored in the tank;

a controller configured to drive the first and second thermoelectric devices; and a heat dissipation unit comprising:

first and second heat transfer blocks corresponding to the first and second thermoelectric devices and configured to absorb the heat from the first and second thermoelectric devices;

a heat sink separated from the tank;

at least two heat pipes including a first heat pipe that connects the first heat transfer block to the heat sink and a second heat pipe that connects the second heat transfer block to the heat sink; and a fan configured to circulate air over the heat sink, wherein the first heat pipe passes through a first portion of the heat sink and the second heat pipe passes through a second portion of the heat sink spaced apart from the first portion.

11. The thermoelectric cooling device according to claim 10, wherein at least a section of the second heat pipe is grooved to prevent a transfer of heat from the heat sink to the second heat transfer block.

12. The thermoelectric cooling device according to claim 11, further comprising a heat transfer plate provided between the tank and the first and second thermoelectric devices, wherein a first planar surface of the heat transfer plate attached to the tank has a surface area equal to a surface area of a first planar surface of the tank.

13. The thermoelectric cooling device according to claim 10, further comprising a case that surrounds the tank, wherein the heat sink and the fan are provided outside of the case.

14. The thermoelectric cooling device according to claim 10, wherein the first thermoelectric device is arranged above the second thermoelectric device, and wherein the controller is configured to selectively turn off the second thermoelectric device.

15. The thermoelectric cooling device according to claim 10, wherein the controller is configured to control each of the first and second thermoelectric devices independently from each other, and wherein the controller is configured to turn on the first and second thermoelectric devices when a temperature of the liquid stored in the tank is higher than a predetermined temperature, and wherein the controller is configured to turn off at least one of the first and second thermoelectric devices when the temperature of the liquid stored in the tank reaches the predetermined temperature.

* * * * *